US005191634A

United States Patent [19]

Couch

[11] Patent Number: 5,191,634

[45] Date of Patent: Mar. 2, 1993

[54] SCREW PLUG IMMERSION HEATER COMPRISING SEPARATE HEADER AND THREADED SLEEVE SECTIONS

[75] Inventor: Nicholas Couch, Huddersfield, England

[73] Assignee: Wellman Thermal Systems Corporation, Shelbyville, Ind.

[21] Appl. No.: 640,186

[22] Filed: Jan. 11, 1991

[51] Int. Cl.[5] ..... H05B 3/78

[52] U.S. Cl. ..... 392/501

[58] Field of Search ..... 392/501, 489, 485–487, 392/497–498, 451–457; 219/523, 526, 437

[56] References Cited

U.S. PATENT DOCUMENTS

| | | | |
|---|---|---|---|
| 1,797,712 | 3/1931 | Brodnax et al. | 219/523 |
| 2,039,641 | 5/1936 | Fichtner | 219/523 |
| 2,223,969 | 12/1940 | Siegler | 219/523 |
| 2,251,556 | 8/1941 | Siegler | 219/523 |
| 2,479,587 | 8/1949 | Morris et al. | 219/516 |
| 2,606,271 | 8/1952 | Morris | 219/551 |
| 2,611,066 | 9/1952 | Freeman | 219/523 |
| 3,319,049 | 5/1967 | Ulanet | 219/523 |
| 4,253,009 | 2/1981 | Jordan | 392/501 |

FOREIGN PATENT DOCUMENTS

| | | | |
|---|---|---|---|
| 686833 | 2/1953 | United Kingdom . | |
| 1487319 | 9/1977 | United Kingdom . | |
| 2176379 | 12/1986 | United Kingdom | 392/498 |
| 2186168 | 8/1987 | United Kingdom | 392/501 |

OTHER PUBLICATIONS

Wellman, "Screw Plug Immersion Heaters", Technical Brochure.

*Primary Examiner*—Bruce A. Reynolds
*Assistant Examiner*—John A. Jeffery
*Attorney, Agent, or Firm*—Fitch, Even, Tabin & Flannery

[57] ABSTRACT

An immersion heater having a screw plug formed from header and sleeve parts. The header part comprises a stamped, thin sheet of metal having a plurality of holes for the heating elements to extend through and a portion of hexagonal configuration to be gripped by a tool. The sleeve part is a threaded piece of pipe to be screwed into the wall of a fluid-containing vessel. The header and sleeve parts are welded together to form the assembled screw plug.

9 Claims, 3 Drawing Sheets

SCREW PLUG IMMERSION HEATER COMPRISING SEPARATE HEADER AND THREADED SLEEVE SECTIONS

FIELD OF THE INVENTION

The present invention is directed to a method and apparatus for providing a screw plug to be used with an immersion heater. More particularly, the present invention is directed to an immersion heater having a screw plug that is threaded into a wall of a fluid-containing vessel.

BACKGROUND OF THE INVENTION

The present invention pertains to electrical immersion heaters and more particularly to immersion heaters which extend through the wall of a fluid-containing vessel.

In a wide variety of applications, it is convenient to heat fluid in a vessel or the like with an electrical immersion heater. Electric immersion heaters are the most widely used means of heating liquids such as water, oil, alkalis, chemical solutions, mild acids, electroplating solutions, salt solutions and many others. Immersion heaters dissipate substantially all of the heat produced by electrical energy conversion to the vessel. More specifically, immersion heating has 100% efficient electrical energy conversion where all heat is dissipated into the liquid. Immersion heaters commonly include a header or plug which extends through and is sealed in an opening in the fluid-containing vessel, a tubular casing or sheath which extends inward of the header and carries the heating elements, and a terminal box wherein the resistive element is electrically connected to external leads. Various other electrical components may also be disposed within the terminal boxes, for example, a thermostat that controls the temperature of the fluid.

The present invention is directed to providing a method which reduces manufacturing costs of a screw plug kind of immersion heater. The method and apparatus in accordance with this invention should reduce the cost of the screw plug used in the immersion heater by 35%–40%.

Some conventional screw plug bodies are manufactured by machining a bushing where about 60% of the bushing is machined away. When using an expensive metal, such as nickel or chrome metal, there is a desire not to waste 60% of the raw material in contouring the bushing to the desired shape.

It is a primary object of this invention to provide a new screw plug and a method of making the same inexpensively. These and other objects and advantages of the invention will become more apparent from the following detailed description and the appended claims.

SUMMARY OF THE INVENTION

An immersion heater includes a screw plug which extends through the wall of a fluid containing vessel, a sheathed resistive element extending into the fluid and a terminal box. The screw plug is formed from two parts as opposed to being machined from a solid metal plug. One part of the screw plug is manufactured by stamping a thin sheet of metal of stainless steel or the like, and the other part is manufactured by threading a piece of pipe made of stainless steel or the like. The screw plug is assembled by joining the two parts together, for example, using a weld. The screw plug is simply and inexpensively manufactured from this method without the waste of expensive stainless steel and the expensive machining operations used hereto to shape the screw plug.

BRIEF DESCRIPTION OF THE DRAWINGS

The present invention will be described in connection with the accompanying drawings, which illustrate the preferred embodiments and details of the invention, and in which.

DETAILED DESCRIPTION OF THE INVENTION

Figure 1:
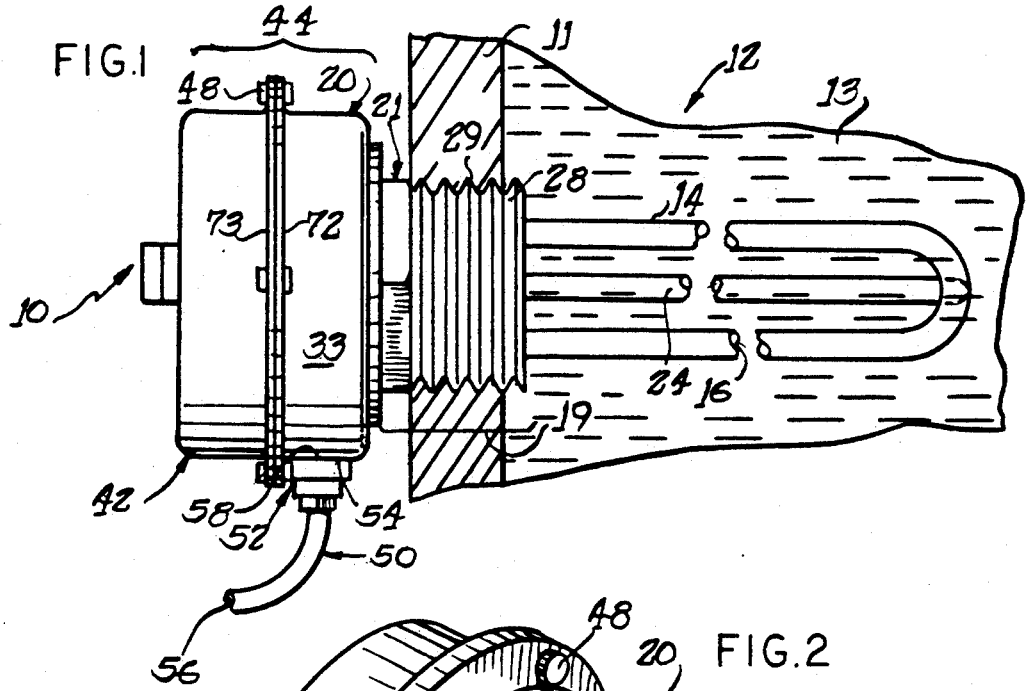
FIG. 1 is an elevation view of an immersion heater embodying various features of the invention, the immersion heater shown extending through the wall of a fluid-containing vessel.

Illustrated in FIG. 1 is an immersion heater 10 which is threaded into a wall 11 of a fluid-containing tank 12. The immersion heater 10 has tubular heater elements or sheaths 14 which extend into the tank and contain in the interior thereof resistive elements 16. A terminal box 20 is carried on a screw plug 19 exteriorly of the tank and external electrical leads 50 are connected to the resistive elements through appropriate electrical components within terminal box 20.

Figure 6:
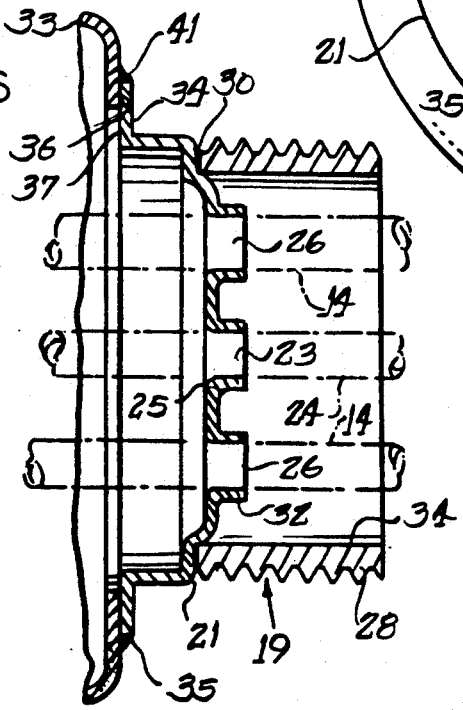
FIG. 6 is a cross-sectional view of an assembled screw plug.

Conventional screw plugs are made of one piece from a piece of stainless steel which currently sells for about $2.50 per pound. The stainless steel is needed to resist corrosion since liquid 13 in the tank 12 is often an acid or other corrosive liquid. The screw plugs are machined to have a large outer header element 21 which mates with and supports the junction box. The header element includes a central plate 25 with openings 26 (FIG. 6) through which project the heater elements 14 and a central opening 23 through which projects a central thermocouple 24. In conventional, prior art screw plugs, the central plate 25 of the header element supports the heater elements and thermocouple in a generally cantilever fashion with the heater elements and thermocouple being brazed to the header element plate at locations that are counterbored to receive the brazing. The screw plug includes a threaded portion or element 28 which is substantially smaller in diameter than the diameter of the header element and includes an exterior machined screw thread 29 for threading into a threaded opening in the tank wall 11. To assist in threading the screw thread into the tank wall, the header element includes a hex head 64 to receive a wrench to turn and tighten the screw plug in the tank wall to prevent leakage about the thread. The piece of stainless steel that is machined was a cylindrical piece having a bore 34 of the needed diameter and an exterior at least as large as a diagonal across the edges 35 of the screw thread. The machining of the cylindrical piece removed about 60% of the metal when forming the hex head and the small diameter screw thread. The forming of the hex head, the boring and counterboring of the openings 23 and 26, and the overall shaping of the screw plug add additional cost to the manufacturing of the conventional screw plug.

In accordance with the present invention, a less expensive screw plug 19 is manufactured by eliminating a great percentage of the waste, scrap stainless steel that is machined off when forming the shape of the screw plug, and by reducing the amount of machining operations needed to complete the screw plug. This is achieved by forming the header element 21 from a stainless steel plate, which is punched in a die into the desired shape, and a small diameter cylindrical piece or pipe of stainless steel that is threaded on its exterior to provided the screw thread 29. The header element is joined to the threaded element 28 by a weld 30 at the end of the threaded element, as last seen in FIG. 6. As will be explained, the header element is preferably formed with projecting cylindrical walls 32 formed in the punching operation about the openings 23 and 26 and these walls 32 may be crimped against the heater element sheaths and the thermal couple sheath to secure the same together.

Referring now in greater detail, to the specific structure illustrated for the preferred embodiment of the invention, the threaded portion 28 is made from a cylindrical piece of metal pipe. The pipe is threaded and cut to an appropriate length. Typically, the pipe will be formed from steel, plated steel, brass or stainless steel. Finally, the screw plug is formed by joining the stamped element 21 with the threaded element 28. The elements can be joined by a weld 30 (FIG. 4), such as a bundy weld. The weld 30 should done in a manner to withstand the forces which will be applied to the screw plug 19, such as when the immersion heater is being fastened tightly into place. Further, the weld 30 should seal the elements tightly together to resist inward flow of fluid. When attaching the immersion heater to the liquid-containing vessel 11, the screw plug 19 is sealed in the threaded vessel opening with appropriate gaskets (not shown) or with a sealing compound applied to its threaded surface.

The heating elements 14 are conventional heating elements normally used with these types of heaters and are formed of a metal that efficiently conducts heat from the internal resistive elements 16 to the fluid and which is usually inert to the contacting fluid. Copper, steel, stainless steel or a nickel-iron-chromium alloy, such as that sold under the trademark Incoloy, are exemplary of metals which may be used for immersible sheaths. In the illustrated embodiment (FIG. 1), a pair of U-shaped tubular heater elements 14 extend from the inner end of the screw plug 19 coextensive with the passageways 26 through the stamped plate 25. The number and shape of the sheathed heating elements 16 may be varied depending on various factors required for the particular application. The heater elements 14 are attached by crimping the punched out walls 32 to engage tightly with the heater elements 14 and/or thermocouple thereby preventing seepage of liquid through the header. The heater elements may also be brazed or soldered between the walls 32 and the heating element walls.

Figure 4:
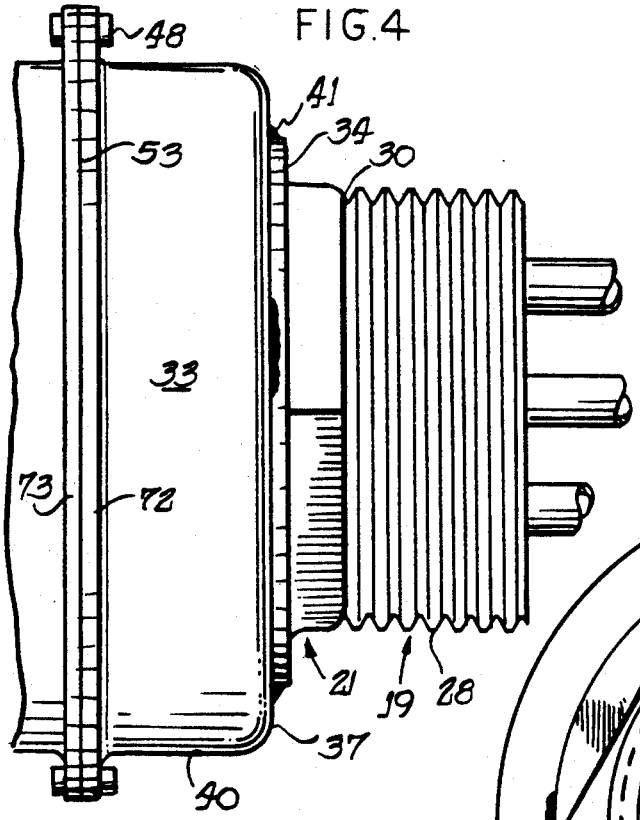
FIG. 4 is an enlarged elevation view of the screw plug and the electrical junction box showing the attachment of the elements.
Figure 7:
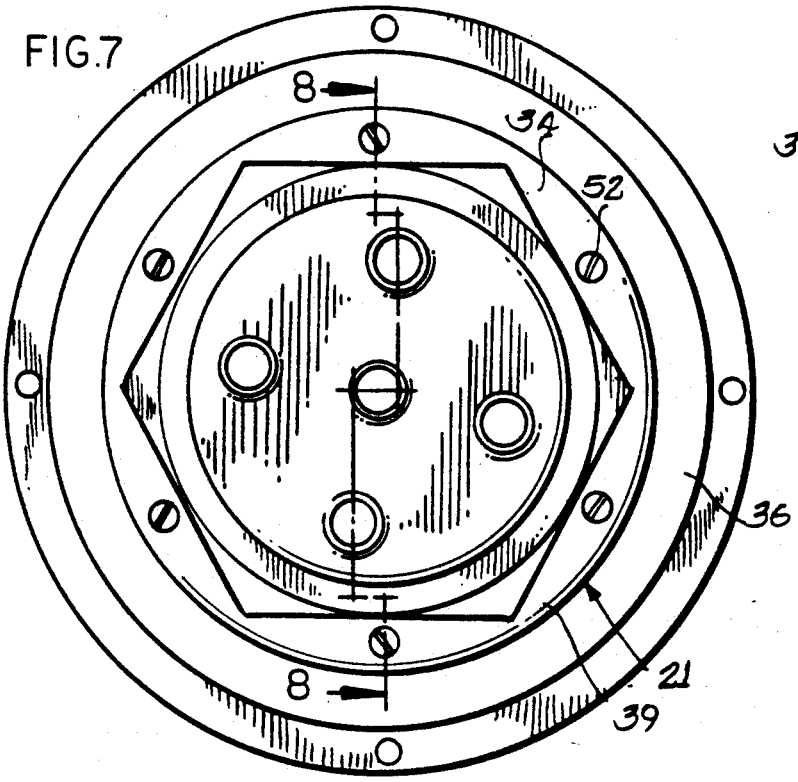
FIG. 7 is a plan view of an alternate bottom of the immersion heater.
Figure 8:
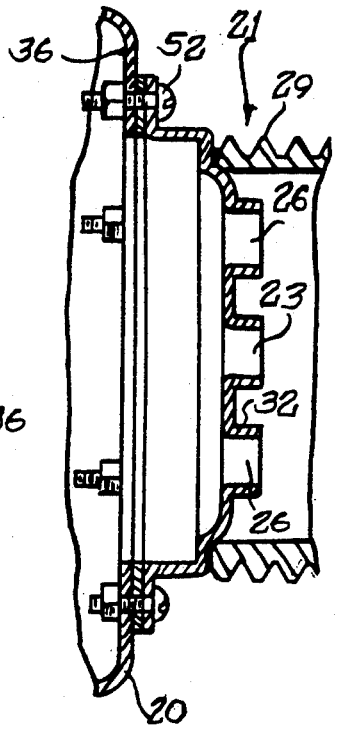
FIG. 8 is a cross-sectional view of an assembled screw plug using the alternate bottom of FIG. 7.
Figure 9:
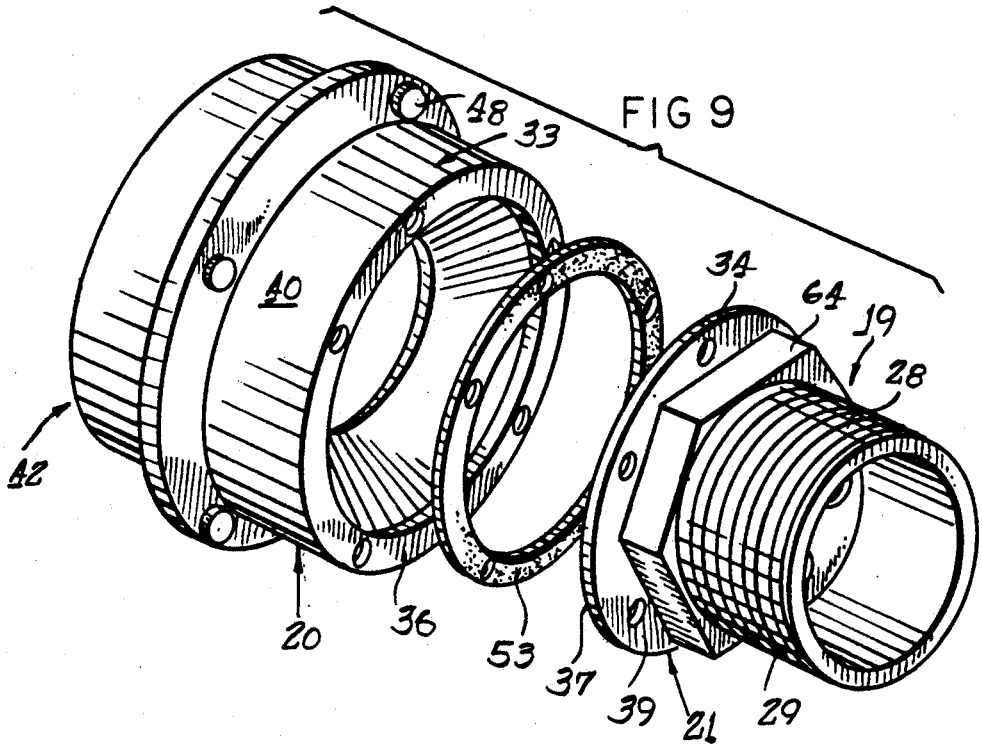
FIG. 9 is an exploded perspective of the screw plug and the electrical box using the alternate bottom of the immersion heater.

The electric junction box 20 is adapted to contain the electrical components usually thermostats and wiring for the screw plug header 34 of the screw plug 19. The electric junction box 20 has a first half or cover 33 which abuts an end flange 34 on the screw plug header 2? . More specifically, a vertical end wall 36 of the cover (FIG. 6) abuts a flat outer vertical surface 37 on the screw plug header flange 34. The cover of electric junction box 20 may be welded by a weld 41 to the screw plug header element 21, as illustrated in FIG. 4. Alternatively shown in FIGS. 7–9, the electric junction box 20 may be secured to the screw plug header 21 by fasteners 52 which extend through apertures in the screw plug flange 34 and cover end wall 36. For a moisture-proof application, a gasket 53 (FIGS. 8 and 9) is interposed between the header flange 34 and end wall 36 of the electrical junction box 20 to prevent liquid from seeping into the electrical junction box 20. The electrical junction box cover includes an encircling wall or cover skirt 40, which is substantially cylindrical, extending from the end wall 36 away from the screw plug header 34 and affording an interior compartment chamber for containment of the electrical components. While in the illustrated embodiment, the skirt 40 is generally cylindrical; however, skirts of other shapes, e.g. square or irregular, may be used depending on the application.

Figure 2:
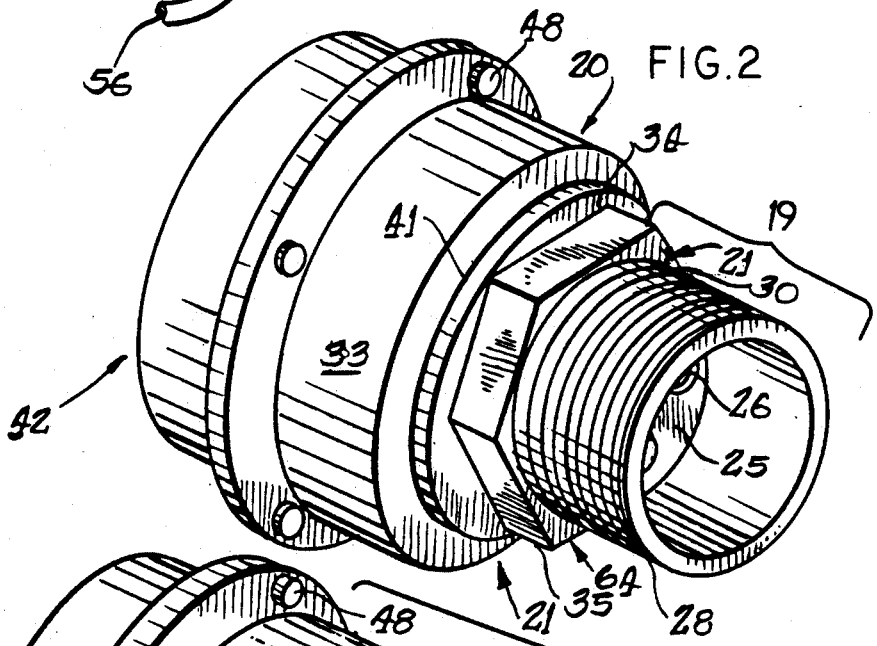
FIG. 2 is an enlarged elevation view of the screw plug and the electrical junction box.
Figure 3:
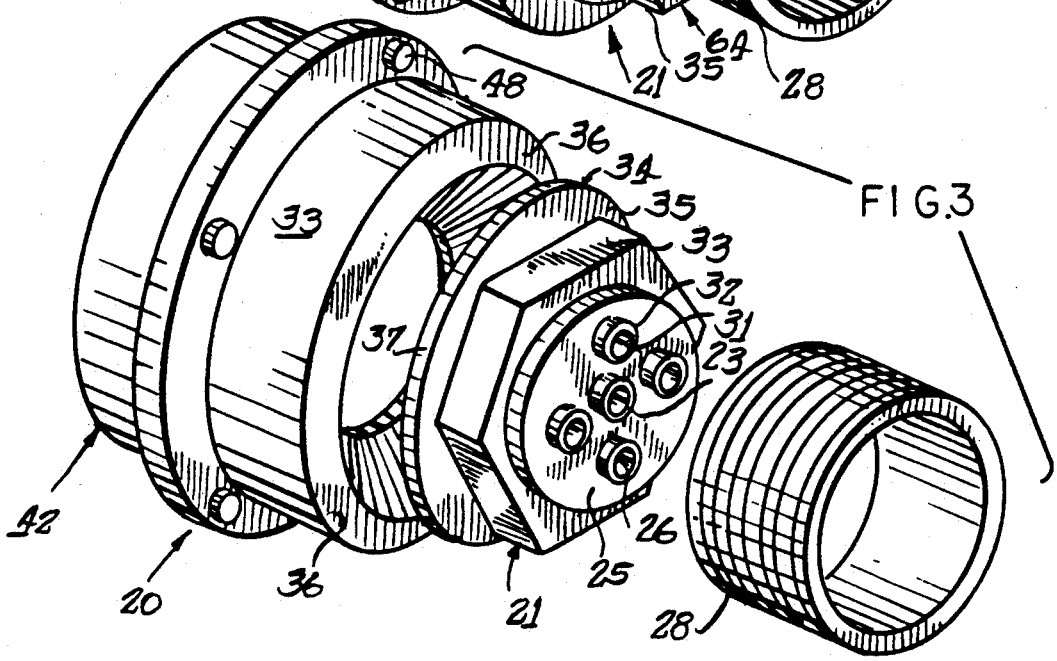
FIG. 3 is an exploded perspective view of the screw plug and the electrical junction box with the screw plug being separated into two parts to display its elements.

The electrical junction box 20 includes a removable second half cover 42 which when removed provides access to the electrical components in the box. In the embodiment illustrated in FIGS. 1–3, the half cover 42 has an internal compartment or chamber 71 adding additional volume to the junction box, a feature particularly advantageous in immersion heaters 10 which have thermostats or other bulky components contained in the junction box. The separate halves 33 and 42 of the junction box 20 have abutted flanges 72, 73 which are aperture to receive bolts 48 secured by nuts (FIG. 8) to hold the electrical junction box 20 halves together.

To maintain a moisture-proof seal between the electrical junction box halves 33 and 42, a gasket 53 (FIGS. 8 and 9) is interposed between them. The gasket 53, formed of resiliently compressible material, has holes aligned with holes through which the bolts 48 extend. When the bolts 48 are tightened and the gasket is compressed, a fluid tight seal is achieved between the first cover half 33 and the second cover half 42 of the electric junction box 20. Although a sealing compound may be substituted for the gasket, gaskets are preferred for junction boxes which are opened and closed for maintenance or setting of the thermostat or other electrical components therein. To provide a moisture-tight connection between the junction box 20 and the external leads 50, a fitting 52 is provided at 54 in the electric junction box skirt wall.

Figure 10:
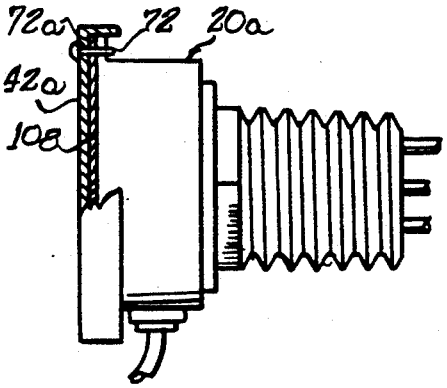
FIG. 10 is an elevational view of an electrical junction box using an alternate cover.

A more compact embodiment of a junction box 20*a* is illustrated in FIG. 10 for immersion heaters having few electrical components in the terminal box. The second cover half 42*a* is generally flat with its outer annular rim portion serving as flange 72*a* to be abutted by a gasket 108 between it and the first half flange 72.

Figure 5:
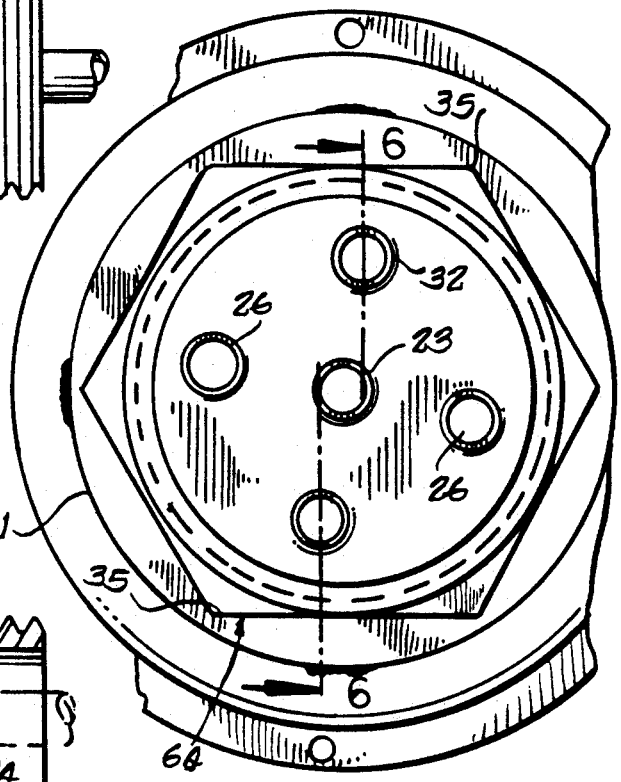
FIG. 5 is a plan view of the bottom of the immersion heater.

From the foregoing, it will be seen that the screw plug 19 is made by a method which reduces the manufacturing costs. While in previous immersion heaters, the screw plug was manufactured from a single bushing of metal, in which approximately 60% of the bushing was machined off which resulted in a costly waste of raw material. In the present invention, the screw plug 19 is made from a cylindrical pipe for the threaded element 19 and a punched sheet metal plate for the header element 21. This reduces the need for machining away much of the raw material. For example, when using an expensive raw material, such as nickel or chrome, the machining off of 60% of the bushing amount to substantial waste of expensive stainless steel and costly machining operations. The screw plug header element 21 is a thin sheet of metal stamped in to the appropriate configuration which in a singular or in a multi-stage punching operation forms from a flat plate, the shape for the hex head 64, the interior, plate 25 which is depressed from the plane of the outer plate flange 34 and the openings 23 and 26 as well as the surrounding cylindrical walls 32 about the openings. The thin sheet of stainless steel is circular; therefore, when stamped, the flange 34 (FIG. 5) remains circular with its inner vertical surface 37 flat to be abutted against a flat end wall 36 on the electrical junction box 20. Preferably, a cylindrical piece of pipe of stainless steel or other non-corrosive metal has a screw thread 29 machined on its outer surface with only the material machined to form the thread being scrap metal. Finally, the screw plug header element 21 is attached to the threaded portion 28 by a welding operation to provide weld 30 connecting one end of the threaded element 28 to the header element 21. The preferred weld is a bundy weld. In the end, this method should reduce the overall cost of the screw plug 35% or 40%.

It will thus be seen that the objects hereinbefore set forth may readily and efficiently be attained and, since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. An immersion heater for heating fluids, comprising:

a header unit stamped from a metal plate, said header unit comprising a central plate having a plurality of openings therethrough and a head portion projecting from the central plate, the head portion having at least one pair of opposed flattened regions to be gripped by a tool;

at least one heater element projecting through the openings in the central plate and secured to the central plate;

a threaded sleeve formed of a separate piece of metal from the metal plate and having a screw thread on the exterior surface of the sleeve; and means joining the sleeve to the metal plate surrounding the central plate whereby a fluid-tight chamber is formed from an interior surface of the sleeve and the metal plate.

2. An immersion heater in accordance with claim 1, in which the central plate has stamped, cylindrical walls at the openings, said stamped cylindrical walls engaging and supporting the heater elements.

3. An immersion heater in accordance with claim 1, in which the means joining the sleeve of stainless metal plate comprises a weld between the central plate and one end of the threaded sleeve.

4. An immersion heater in accordance with claim 1, where the metal plate is a sheet of stainless steel and including an encircling flange about the head portion for attachment to a junction box.

5. An immersion heater in accordance with claim 1 wherein the threaded sleeve is a threaded piece of pipe of an appropriate length for connection through a wall of a fluid-containing vessel.

6. An immersion heater, comprising:

an electrical junction box;

a screw plug header for fastening the immersion heater to a fluid containing vessel and having a flange portion for joining to the electrical junction box;

the screw plug header having the flange thereon and an integral punched body of a substantially uniform cross-sectional thickness;

electrical heating elements extending outwardly from the punched body; and a sleeve having a screw thread for screwing into the vessel, the sleeve being formed of a threaded pipe, said sleeve being welded to the punched body of the screw header.

7. An immersion heater in accordance with claim 6 where the screw plug header is a drawn sheet of stainless steel.

8. An immersion heater in accordance with claim 6 where the screw plug and the electrical junction box are joined together by a weld.

9. An immersion heater in accordance with claim 6 where the punched body comprises a pair of opposed flattened regions to be gripped by a tool.

* * * * *

UNITED STATES PATENT AND TRADEMARK OFFICE

CERTIFICATE OF CORRECTION

PATENT NO. : 5,191,634

DATED : March 2, 1993

INVENTOR(S) : Nicholas Couch

It is certified that error appears in the above-identified patent and that said Letters Patent is hereby corrected as shown below:

Column 1, Line 21, change "Electric" to --Electrical--.

Column 3, Line 25, change "provided" to --provide--.

Column 3, Line 43, after "should" insert --be--.

Column 4, Line 11, change "2? ." to --21.--.

Column 5, Line 7, change "19" to --28--.

Column 6, Line 16, change "of stainless" to --to the--.

Signed and Sealed this

Fourth Day of January, 1994

Bruce Lehman

*Attest:*

BRUCE LEHMAN

*Attesting Officer*

*Commissioner of Patents and Trademarks*